US005987281A

United States Patent [19]

Kurotori et al.

[11] Patent Number: 5,987,281

[45] Date of Patent: Nov. 16, 1999

[54] IMAGE FORMING APPARATUS

[75] Inventors: Tsuneo Kurotori, Tokyo; Makoto Obu; Sadayuki Iwai, both of Kanagawa, all of Japan

[73] Assignee: Ricoh Company, Ltd., Tokyo, Japan

[21] Appl. No.: 09/027,734

[22] Filed: Feb. 23, 1998

[30] Foreign Application Priority Data

| | | | |
|---|---|---|---|
| Feb. 24, 1997 | [JP] | Japan | 9-057003 |
| Feb. 24, 1997 | [JP] | Japan | 9-057004 |
| Feb. 24, 1997 | [JP] | Japan | 9-057005 |
| Dec. 27, 1997 | [JP] | Japan | 9-368201 |

[51] Int. Cl.[6] ..... G03G 15/10

[52] U.S. Cl. ..... 399/237; 134/104.1; 399/249; 399/348; 399/358

[58] Field of Search ..... 399/237, 249, 399/251, 348, 358, 359, 360; 430/33, 117, 118; 134/6, 9, 10, 104.1, 104.2

[56] References Cited

U.S. PATENT DOCUMENTS

| | | | |
|---|---|---|---|
| 4,800,839 | 1/1989 | Ariyama et al. . | |
| 4,801,965 | 1/1989 | Mochizuki et al. . | |
| 5,021,834 | 6/1991 | Tsuruoka et al. . | |
| 5,155,534 | 10/1992 | Kurotori et al. | 430/117 X |
| 5,404,209 | 4/1995 | Matsuoka et al. | 399/249 |
| 5,642,188 | 6/1997 | Mochizuki et al. | 399/237 |
| 5,652,080 | 7/1997 | Yoshino et al. | 399/240 X |
| 5,666,616 | 9/1997 | Yoshino et al. | 399/240 X |
| 5,708,938 | 1/1998 | Takeuchi et al. | 399/250 |
| 5,826,145 | 10/1998 | Fukae | 399/237 X |

FOREIGN PATENT DOCUMENTS

| | | |
|---|---|---|
| 62-145273 | 6/1987 | Japan . |
| 5-313500 | 11/1993 | Japan . |
| 7-36085 | 4/1995 | Japan . |
| 7-152254 | 6/1995 | Japan . |
| 7-209922 | 8/1995 | Japan . |
| 7-239615 | 9/1995 | Japan . |

*Primary Examiner*—Matthew S. Smith

*Attorney, Agent, or Firm*—Oblon, Spivak, McClelland, Maier & Neustadt, P.C.

[57] ABSTRACT

A developing device develops a latent image formed on a latent image carrier by supplying a developer to the latent image carrier. The developer comprises a carrier liquid and a toner dispersed in the carrier liquid. A gelling agent adding device adds a gelling agent to the developer remaining in the developing device so as to gel the developer.

29 Claims, 11 Drawing Sheets

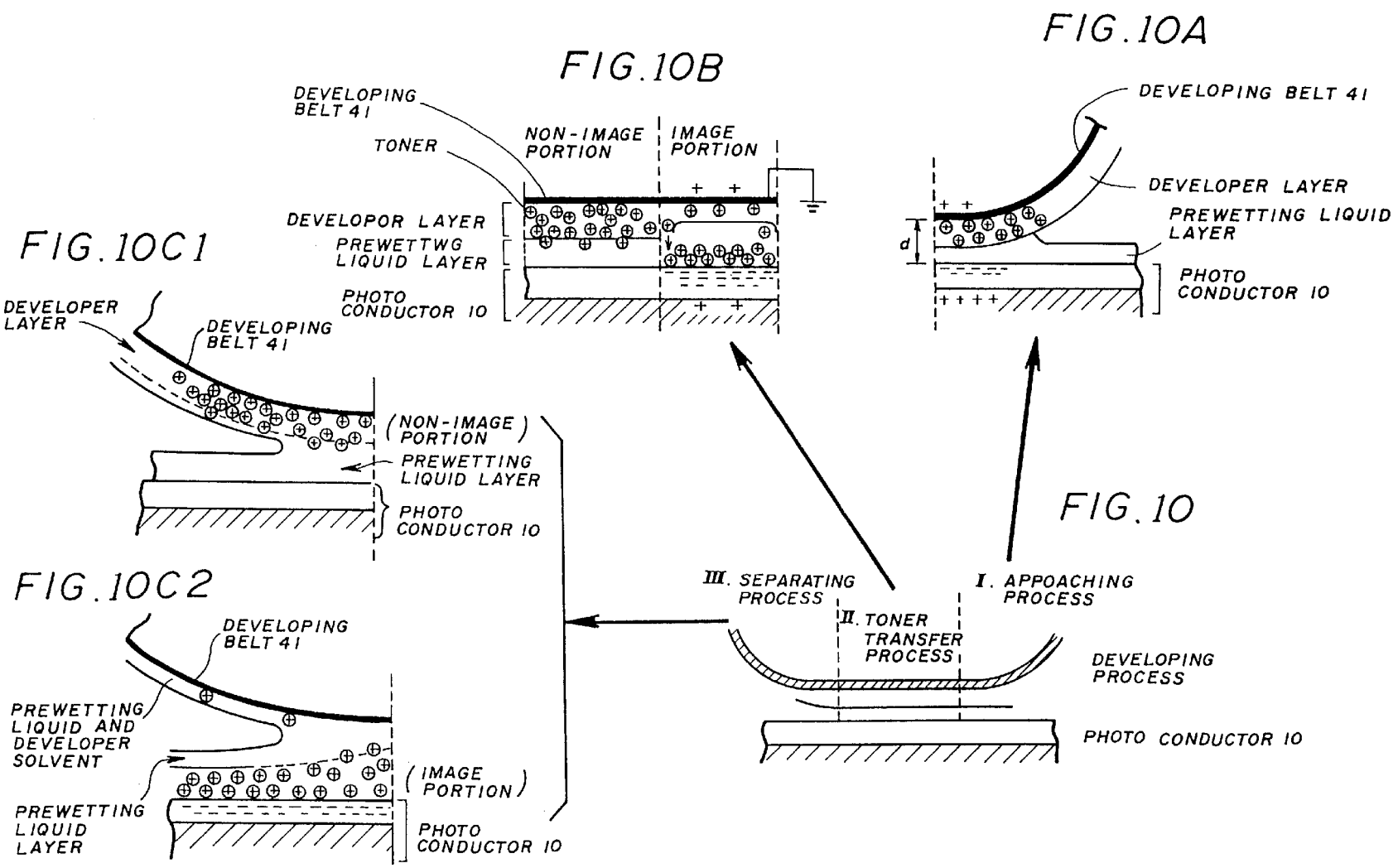
FIG. 10A
DEVELOPING BELT 41
DEVELOPER LAYER
PREWETTING LIQUID LAYER
PHOTO CONDUCTOR 10
d
FIG. 10
I. APPOACHING PROCESS
II. TONER TRANSFER PROCESS
III. SEPARATING PROCESS
DEVELOPING PROCESS
PHOTO CONDUCTOR 10
FIG. 10B
IMAGE PORTION
NON-IMAGE PORTION
DEVELOPING BELT 41
TONER
DEVELOPOR LAYER
PREWETTWG LIQUID LAYER
PHOTO CONDUCTOR 10
FIG. 10C1
DEVELOPING BELT 41
DEVELOPER LAYER
(NON-IMAGE PORTION)
PREWETTING LIQUID LAYER
PHOTO CONDUCTOR 10
FIG. 10C2
DEVELOPING BELT 41
PREWETTING LIQUID AND DEVELOPER SOLVENT
(IMAGE PORTION)
PREWETTING LIQUID LAYER
PHOTO CONDUCTOR 10

IMAGE FORMING APPARATUS

BACKGROUND OF THE INVENTION

1. Field of the Invention

The present invention relates to an image forming apparatus such as a copying machine, a facsimile machine, a printer or the like. In detail, the present invention relates to an image forming apparatus in which a latent image formed on a latent image carrier through electrophotography, electrostatic recording, iongraphy or the like is visualized with liquid developer which is a liquid developing agent. Then, the developed image on the latent image carrier is transferred to a transfer body. Further, in order to use the latent image carrier repeatedly, after the developed image has been transferred, the residual developer is removed from and thus cleans the surface of the latent image carrier.

2. Description of the Related Art

In such a kind of a wet type image forming apparatus, a developing device is used which develops an electrostatic latent image, formed on a latent image carrier such as a photoconductor, using a toner which includes electrically charged particles. Further, in order to clean the latent image carrier, a cleaning liquid is supplied to the latent image carrier at a portion to be cleaned. There are a device which uses the developer which is contained in the developer tank of the developing device as the cleaning liquid, and a device which uses a special cleaning liquid contained in a cleaning liquid tank. In each of the devices, after the cleaning liquid has been supplied to the latent image carrier and used for cleaning, the cleaning liquid including the residual toner is collected in the above-mentioned developer tank or the above-mentioned cleaning liquid tank, and is used repeatedly.

In the device in which the developer is also used as the cleaning liquid, paper powder adhered on the latent image carrier, lumps of the toner adhered to a cleaning blade and so forth gradually mix with the developer. Then, after image forming has been performed tens of thousands of times, the physical properties of the developer change and thus come to be unsuitable for developing. Accordingly, such an old developer, the physical properties of which have changed, is removed from the developing device and is replaced with a new developer. As a method of treating such an old developer, a method of treating developer for electrostatic photography has been proposed (Japanese Patent Publication No.7-36085). In this method, after an oil coagulating agent is added to the old developer and thus, the old developer is coagulated, the coagulated material is compressed so that a developer solvent is collected therefrom, and the residue is treated as industrial waste. In this method, when the oil coagulating agent is added to the old developer, it is necessary to heat the developer to approximately 80° C. so as to coagulate the developer. A method of treating such an old developer, in which, in addition to the oil coagulating agent, a coagulation facilitating agent is added to the old developer so that heating of the old developer is not needed, has been proposed (Japanese Laid-Open Patent Application No.5-313500).

A cleaning device has been proposed (Japanese Laid-Open Patent Application No.62-145273). In this device, after being used in the cleaning process, the special cleaning liquid is collected in the cleaning liquid tank and is used repeatedly. In the device, in order to maintain the cleaning liquid as a clean liquid, means for detecting the concentration of the toner in the cleaning liquid and means for removing and collecting the toner from the cleaning liquid through electrodeposition are provided. Then, the toner removing and collecting means is operated when the concentration of the toner exceeds a predetermined value.

Further, in order to miniaturize the developing device, use of a high concentration, high viscosity developer has been proposed (see Japanese Laid-Open Patent Application Nos.7-209922, 7-152254, 7-239615). In such a method, the concentration of the toner in the developer, which consists of an insulating liquid with the toner dispersed therein, is set to a high level. For example, in Japanese Laid-Open Patent Application No.7-209922, a method for liquid-developing the latent image formed on the latent image carrier with the toner as visualizing particles, which method is provided with a developing process of supplying the liquid developer to the latent image surface of the photoconductor by bringing the liquid developer having a high viscosity of 100 to 10000 mPa.s with the dispersed toner in high concentration in insulating liquid applied to a developing roller into contact with the photoconductor, has been proposed.

Further, in Japanese Laid-Open Patent Application No.7-209922, a liquid-developing method has been also proposed. In the method, prior to the developing process, a prewetting process is performed. In the prewetting process, a prewetting liquid is coated on the latent image carrier. The prewetting liquid has mold release characteristics and is a chemically inert dielectric liquid. In the prewetting process, a prewetting liquid layer separates the layer of the liquid developer supplied to the latent image carrier from the surface of the latent image carrier. Thereby, unnecessary adhesion of the toner on the latent image carrier is prevented, and thus, image degradation due to adhesion of the toner to non-image portions on the photoconductor is prevented.

However, in the treatment of the old developer in the method in which the developer is also used as the cleaning liquid, when a serviceman removes the old developer from the developing device, adds the oil coagulating agent to the old developer so as to coagulate the old developer, and compresses the coagulated material so as to collect the developer solvent therefrom, manually, a long time is required for replacing the developer.

Further, in the method in which the toner is collected through electrodeposition from the special cleaning liquid contained in the cleaning liquid tank so that the cleaning liquid is maintained to be clean, the rate of collection of the toner from the cleaning liquid through the electrodeposition is in proportion to the size of the electrode and the time of the toner collection. Accordingly, in order to increase the rate of collection of the toner, the device is enlarged and/or the time of the toner collection is elongated.

Also, a filter can be used instead of using electrodeposition. The filter is used to trap only the toner and cause the developing solvent to pass therethrough. Thus, the toner is collected from the cleaning liquid. However, similar to the method using electrodeposition, the rate of collection of the toner is in proportion to the size of the filter and the time for the toner collection. Accordingly, in order to increase the rate of collection of the toner, the device is enlarged and/or the time for the toner collection is increased.

Further, when the liquid-developing method provided with the prewetting process is performed in the transfer type electrophotographic apparatus, the developer and also the prewetting liquid remain on the photoconductor after the transfer process. This residual prewetting liquid is then collected in the cleaning process together with the developer. Therefore, when the developer in the developer tank of the developing device is used as the cleaning liquid, and the developer which has been used as the cleaning liquid is returned to the developer tank, the amount of prewetting liquid in the developer tank increases gradually. When the kind of prewetting liquid is different from the kind of developer solvent of the developer, the characteristics of the developer change and thereby the developer may not be used for developing. Specifically, when the liquids of different kinds are mixed together, the electric resistance or the like of the developer changes and the developing characteristics may change. Further, when the liquids of different viscosities are mixed together, the viscosity of the developer changes, and thereby, in the device in which a developing belt or a developing roller is used for conveying the developer and the rate of supply of the developer to the latent image carrier depends on the viscosity of the developer, the rate of supply of the developer to the latent image carrier may change and thereby the developing tone may change.

Further, in such a developing device which uses the liquid developer, generally speaking, a drain (drainage hole) is provided at the bottom plate or a side wall near the bottom of the developing device. The drain is used for the old developer to flow therethrough. The drain is usually closed by a rubber plug or the like when the developing device operates. The drain is opened as a result of the rubber plug or the like being removed when the developer is caused to flow out from the developing device, for example, when the developer is replaced.

However, in an image forming apparatus provided with such a developing device, the developing device may be inclined when the drain is opened and the developer flows out therethrough. In such a case, all of the developer in the developing device may not flow out and some amount of the developer may remain in the developing device. In such a case, when the developing device is detached from the apparatus body or the developing device detached from the apparatus is carried, the residual developer may spill from the developing device through the drain.

SUMMARY OF THE PRESENT INVENTION

The present invention has been devised in consideration of the above-described background. An object of the present invention is to provide an image forming apparatus by which the problem of spillage of the developer remaining in the developing device is solved.

Another object of the present invention is to provide an image forming apparatus in which the rate of collection of the toner from the liquid which has been used in the cleaning process can be increased.

Another object of the present invention is to provide an image forming apparatus in which the liquid which has been used in the cleaning process can be reused in a manner depending on the properties of the liquid.

An image forming apparatus, according to the present invention, comprises:

developing means for developing a latent image formed on a latent image carrier by supplying a developer to the latent image carrier, the developer comprising a carrier liquid and a toner dispersed in the carrier liquid; and gelling agent adding means for adding a gelling agent to the developer remaining in the developing means so as to gel the developer.

In this apparatus, the developer remaining in the developing means is gelled as a result of the gelling agent being added to the developer. Thereby, spillage of the developer remaining in the developing means, when, for example, the developing means is carried, can be prevented.

The gelling agent adding means may comprise:

gelling agent containing means for containing the gelling agent, the gelling agent containing means being located at a position such that the gelling agent contained in the gelling agent containing means is not in contact with the developer provided in the developing means; and gelling agent putting or providing means for putting or providing the gelling agent contained in the gelling agent containing means into the developing means in response to an operation for starting detachment of the developing means from the apparatus body.

Thereby, it is possible to avoid a problematic situation where, although the developing means loaded in the apparatus body is in the state in which the developing means can properly operate (the state in which a sufficient amount of the developer is contained in the developing means), the gelling agent is erroneously added to the developer by the gelling agent putting means.

The image forming apparatus may further comprises developer stirring controlling means for causing a developer stirring member, disposed in the developing means, to stir the developer contained in the developing means, after the gelling agent putting means puts the gelling agent into the developer contained in the developing means.

Thereby, without providing special stirring means for the gelation process, the developer remaining in the developing means and the gelling agent added to the developer are stirred by the stirring means which is provided to work in the ordinary developing process, and thus, gelation of the developer is facilitated so that the time required for the gelation is shortened.

Another image forming apparatus, according to the present invention, comprises:

developing means for developing a latent image formed on a latent image carrier by supplying a developer to the latent image carrier, the developer comprising a carrier liquid and a toner dispersed in the carrier liquid; and liquid absorber putting or providing means for putting or providing a liquid absorber into the developer remaining in the developing means, the liquid absorber having a property of absorbing the developer.

Thereby, the developer remaining in the developing means is absorbed by the liquid absorber, and thus, spilling of the developer from the developing means can be prevented.

Another image forming apparatus, according to the present invention, comprises:

developing means for developing a latent image formed on a latent image carrier by supplying a developer to the latent image carrier, the developer comprising a carrier liquid and a toner dispersed in the carrier liquid;

transferring means for transferring the developed image, formed on the latent image carrier by the developing means, into a transfer body;

cleaning means for removing residual developer from the surface of the latent image carrier so as to clean the surface of the latent image carrier after the transferring means transfers the developed image into the transfer body; and carrier liquid separating means for gelling the developer removed from the latent image carrier by the cleaning means, and separating the gelled developer into a gelatinous solid component and a carrier liquid component.

In this apparatus, the carrier liquid separating means gels the developer removed from the latent image carrier by the cleaning means, and separates the gelled developer into a gelatinous solid component and a carrier liquid component. Because the gelation and the separation are performed by the carrier liquid separating means provided in the image forming apparatus, it is possible to reuse the carrier liquid component, as a result of supplying this carrier liquid component to the developing means and/or the cleaning means. Further, because a mechanism for adding the gelling agent may be such that merely a predetermined amount of the gelling agent can be added to the developer, it is possible to miniaturize the mechanism in comparison to the mechanism in the related art for removing the toner through electrodeposition in a special cleaning tank. Further, because the residual developer is gelled through the chemical process by addition of the gelling agent, the toner separation can be efficiently performed in comparison to the toner separation through electrodeposition.

The image forming apparatus may further comprise circulating means for supplying the carrier liquid component separated by the carrier liquid separating means to at least one of the developing means and the cleaning means.

In this apparatus, because the separated carrier liquid is reused as a solvent for making-up the cleaning liquid and/or the developer, it is possible to reduce the rate of supply of the solvent to the apparatus. Thus, the running cost can be reduced.

The image forming apparatus may further comprise a holding means for holding the gelatinous solid component separated by the carrier liquid separating means, the holding means being detachable from the apparatus body.

Thereby, it is easy to discard the gelatinous solid component, together with the holding means.

In the image forming apparatus in which the rate of supply of the developer to the latent image carrier depends on the viscosity of the developer provided in the developing means, the apparatus may further comprise prewetting liquid coating means for coating a prewetting liquid on the surface of the latent image carrier, before the developer is supplied to the latent image carrier by the developing means, in order to prevent direct contact of the developer with the surface of the latent image carrier; and the kind and the viscosity of the prewetting liquid are the same as the kind and the viscosity of the carrier liquid of the developer, respectively.

In this arrangement, the prewetting liquid, coated on the latent image carrier by the prewetting liquid coating means, is removed and collected together with the residual developer. This prewetting liquid is separated from the gelatinous solid component together with the carrier liquid component of the developer by the carrier liquid separating means. The thus-separated prewetting liquid is also reused as a result of being supplied to the developing means and/or the cleaning means. Because the viscosity of the prewetting liquid is the same as the viscosity of the carrier liquid of the developer, when the prewetting liquid is reused as the make-up solvent of the developer, the rate of supply of the developer to the latent image carrier does not change in the image forming apparatus in which the rate of supply of the developer to the latent image carrier depends on the viscosity of the developer provided in the developing means, The image forming apparatus may further comprise:

prewetting liquid coating means for coating a prewetting liquid on the surface of the latent image carrier, before the developer is supplied to the latent image carrier by the developing means, in order to prevent direct contact of the developer with the surface of the latent image carrier; and circulating means for supplying the carrier liquid component of the developer and the prewetting liquid component separated by the carrier liquid separating means to the cleaning means.

Also in this case, the prewetting liquid, coated on the latent image carrier by the presetting liquid coating means, is removed and collected together with the residual developer, and the prewetting liquid is separated from the gelatinous solid component together with the carrier liquid component of the developer by the carrier liquid separating means. However, in this arrangement, because the thus-separated mix of the prewetting liquid and the carrier liquid of the developer is supplied to the cleaning means but is not supplied to the developing means. Accordingly, the prewetting liquid is not mixed with the developer in the developing means. Therefore, even if the characteristics of the prewetting liquid and the carrier liquid of the developer are different from one another, it is possible to maintain a fixed composition of the developer in the developing means. Thereby, the characteristics of the developer do not change, and it is possible to maintain a stable image quality.

The carrier liquid and the gelling agent may have properties such that gelation of the developer is facilitated in a temperature range higher than an ordinary temperature; and a developer containing portion provided in the carrier liquid separating means may be located in the proximity of a heat generating portion of the apparatus.

In this apparatus, the developer containing portion provided in the carrier liquid separating means is located in the proximity of a heat generating portion of the apparatus, such as a fixing device provided with heating means. The temperature of the developer containing portion of the carrier liquid separating means is increased by residual heat and/or generated heat of the fixing device. Thereby, it is possible to shorten the reaction time required for the gelation of the collected developer. Thereby, the gelation process can be frequently performed with frequent removal of the gelled developer from the developer containing portion. As a result, it is possible to increase the printing speed of the image forming apparatus, and it is possible to miniaturize the size of the developer containing portion of the carrier liquid separating means.

The image forming apparatus may further comprise heating means for heating the developer containing portion of the carrier liquid separating means. Thereby, the gelation of the developer contained in the developer containing portion can be positively facilitated. Further, even in a case where the temperature of the above-mentioned heat generating portion of the apparatus increases and decreases depending on the state of the apparatus, the gelation can be facilitated without regard to the temperature of the heat generating portion.

The image forming apparatus may further comprise controlling means for causing the heating means to start working when the amount of the developer in the developer containing portion has reached a fixed amount.

Thereby, in comparison to a case where the heating means always works, the heating efficiency can be increased.

The carrier liquid may be an oil-based liquid; and the gelling agent may comprise an oil absorbing polymer material.

The gelling agent may comprise at least one of Alkyl styrene and Alkyl m-acrylate, each of which has a three-dimensional cross-linked structure.

The gelling agent may comprise at least one of 12-hydroxy stearic acid and N-lauroylglutamicacid dibutylamido.

The gelling agent may comprise Polyisobutylene having an oil attraction property.

Other objects and further features of the present invention will become more apparent from the following detailed description when read in conjunction with the accompanying drawings.

BRIEF DESCRIPTION OF THE DRAWINGS

FIGS. 10, 10A, 10B, 10C1 and 10C2 illustrate a developing process of an image forming method provided with a prewetting liquid coating process in the copying machine shown in FIG. 9;

DETAILED DESCRIPTION OF THE PREFERRED EMBODIMENTS

An electrophotographic copying machine (hereinafter, simply referred to as a copying machine) in a first embodiment of the present invention will now be described.

Figure 1:
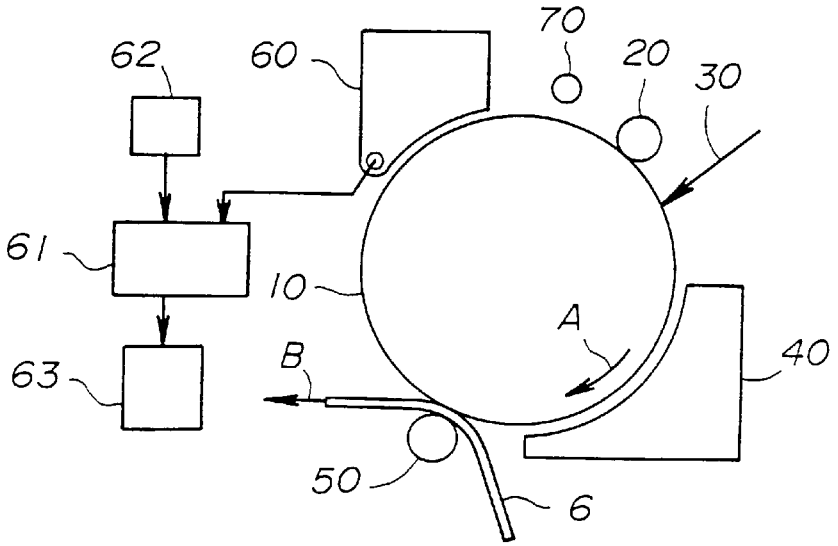
FIG. 1 shows a front view indicating a general arrangement of a copying machine in a first embodiment of the present invention.

FIG. 1 shows a front view indicating a general arrangement of the copying machine in the first embodiment. In the copying machine, a photoconductor 10 is driven and rotated in the arrow A direction, and, after the surface of the photoconductor 10 is uniformly electrically charged by a charging roller 20, the surface of the photoconductor 10 is irradiated by light 30 from an exposure device (not shown in the figure) so that an electrostatic latent image is formed on the surface of the photoconductor 10. This electrostatic latent image is developed by a developing device 40 and thus a toner image as a visible image is formed on the surface of the photoconductor 10. This toner image is transferred to transfer paper 6, which has been conveyed to the surface of the photoconductor 10 from a paper supply portion (not shown in the figure) in the arrow B direction, by a transfer roller 50. The transfer paper 6, to which the toner image has been transferred, is removed from the photoconductor 10 by a removing device (not shown in the figure), and is conveyed by, for example, a conveying belt device 51 shown in FIG. 5. Then, the toner image is fixed on the transfer paper 6 in a fixing process by a fixing device 54 (shown in FIG. 5) which has a heater roller 52 with a built-in heater as heating means, a pressing roller 53 and a heat insulating cover 55. The transfer paper 6 which has undergone the fixing process is ejected from the copying machine. Part of the toner on the photoconductor 10 which was not transferred to the transfer paper 6 is removed from the photoconductor 10 and collected by a cleaning device 60. Then, in order to enable subsequent charging of the photoconductor 10, the residual electric charge on the photoconductor 10 is removed by a removing device 70.

The above-mentioned developing device 40 uses an oil-based liquid developer (almost all of which consists of a solvent of the hydrocarbon family) derived from dispersing a toner consisting of carbon black which is covered by a resin in the developer solvent. The developer solvent consists of a solvent of the petroleum family such as Isoper (brand name of EXXON CHEMICAL Co., Ltd.).

In this copying machine, an oil absorbing polymer material, used as a gelling agent, is added to the developer collected by the cleaning device 60. Then, after the collected developer is gelled, the gelled developer is separated into a gelatinous component and a solvent component.

FIG. 1 shows one example of this arrangement. A gelling unit 61 is connected to the cleaning device 60, the liquid from the cleaning device 60 is stored in the gelling unit 61. An oil absorbing material adding unit 62 is connected to the gelling unit 61, and the oil absorbing polymer material contained in the oil absorbing material adding unit 62 can be added to the developer in the gelling unit 61. The gelling unit 61 is provided with separating means for separating the gelled toner into the toner component and the developer solvent. Further, a separated liquid tank 63 is connected to the gelling unit 61 so that the developer solvent (hereinafter, referred to separated solvent) which has been separated by the separating means and discharged from the gelling unit 61 is stored in the separated liquid tank 63. It is possible that these gelling unit 61, oil absorbing material adding unit 62 and separated liquid tank 63 are formed integrally.

Three examples of the oil absorbing polymer material to be added to the collected developer will now be described.

A first example is Alkyl styrene, Alkyl m-acrylate, and Hydroxy alkyl m-acrylate. In each of these materials, polymers having a loose three-dimensional network structure absorb the oil component into the network.

A second example is 12-hydroxy stearic acid and N-lauroylglutamicacid dibutylamido. In each of these materials, polymers that do not have the three-dimensional network structure, form a loose network in oil, and the oil component is absorbed into the network. These polymers are oil soluble polymers having an orientation property.

A third example is polymers of the Poly alkyl acrylate family such as Polyisobutylene having an oil attraction property. In each of these materials, the oil component is entangled due to the oil attraction property and is gelled.

At least one of the above-mentioned materials of one example is added to the collected developer in an amount of several percent in volume. Then, the thus-obtained liquid is heated in a range on the order from 45 to 80° C., or the collected developer is heated in the range on this order before the above-mentioned material is added to the developer, and the above-mentioned material is added to the thus-heated developer. Thereby, it is possible to increase the reaction speed of the gelation.

At least one of the above-mentioned oil absorbing polymer materials of one example is contained in the oil absorbing material adding unit 62, and a fixed quantity can be added to the collected developer. Further; the gelling unit 61 can be heated and the collected developer is heated. The arrangement for the heating will be described later.

The gelled collected developer is separated into the toner component and the developer solvent component by the separating means. One example of the separating means is a pressure separating device having a container provided with filter paper at a part thereof. By pressing the gelled developer onto the filter paper, the gelled developer is separated into the toner component and the developer solvent component. It is preferable that the filter paper is supported by a mesh-shape member. By using such a pressure separating device, the gelled, mainly toner component is trapped by the filter paper and the separated solvent is pressed out of the gelled developer via the filter paper. The purity of the pressed-out liquid depends on the amount of the gelling agent added to the collected developer. It is preferable that, in order to obtain the liquid including no toner and thus having the purity of 100%, a sufficient amount of the gelling agent is added to the collected developer so that all of the toner component can be gelled.

Figure 2:
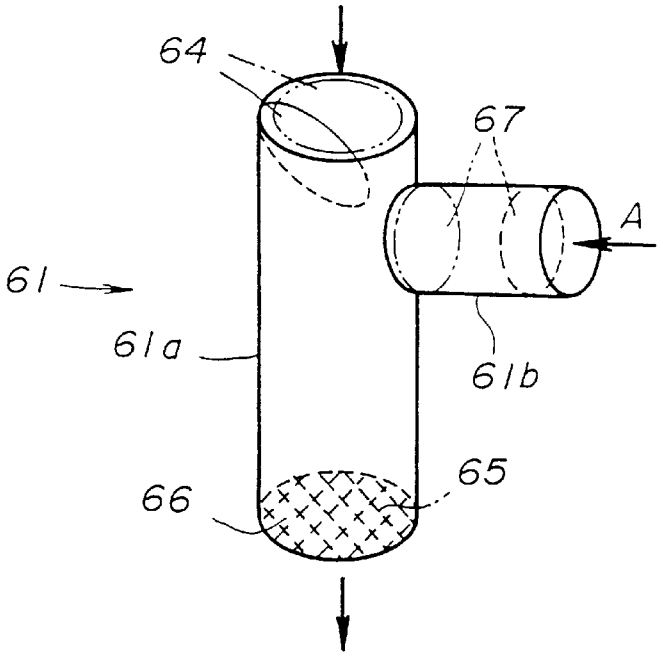
FIG. 2 shows one example of a gelling unit in the copying machine shown in FIG. 1.

FIG. 2 shows one example of the gelling unit 61 which has the function of the above-mentioned pressure separating device in addition to the developer gelling function. The gelling unit 61 comprises of a T-shape container including a storage and pressure container portion 61*a* and a pressure pipe portion 61*b*. A top lid 64 opens and closes the top opening of the storage and pressure container portion 61*a*. When the top lid 64 is inclined downward as shown in FIG. 2 (indicated by the solid line), the top opening of the storage and pressure container portion 61*a* is opened. Therethrough, the collected developer enters the storage and pressure container portion 61*a* from the top. Then the collected developer is stored on filter paper 66 supported by a filter supporting mesh member 65. The bottom opening of the storage and pressure container portion 61*a* is covered by the filter supporting mesh member 65. When a fixed quantity of the collected developer is stored in the storage and pressure container portion 61*a*, the oil absorbing polymer material is added to the stored developer through the top opening. When the gelled developer is pressed, the top lid 64 closes the top opening (indicated by the chain double-dashed line), and thereby, the sealed condition can be established.

By, for example, mechanically pressing a pressure lid 67 in the pressure pipe portion 61*b* in the arrow A direction, the pressure in the storage and pressure container portion 61*a* increases. The pressure lid 67 moves, as a piston, from the position indicated by the broken line to the position indicated by the chain double-dashed line, and the pressure in the storage and pressure container portion 61*a* increases. By this compression, the separated solvent is pressed out of the gelled developer via the filter paper 66.

The structure is such that, when the pressure in the storage and pressure container portion 61*a* increases, the filter paper 66 supported by the filter supporting mesh member 65 resists the pressure applied thereto.

The gelling unit 61 is detachable from the apparatus body, and the entire gelling unit 61 is discarded after the separated solvent is pressed out of the collected developer, and the used gelling unit 61 is replaced with a new gelling unit 61. It is also possible that the filter paper 66 and the filter supporting mesh member 65 are detachable from the body of the storage and pressure container portion 61*a*, and they are discarded with the gelled residual and are replaced with new filter paper 66 and a new filter supporting mesh member 65.

In the example shown in FIG. 2, storage, gelation and pressing of the collected developer are performed in one container (the storage and pressure container portion 61*a*). However, it is also possible that a container is provided for each process of the storage process, the gelation process and the pressing process. Further, it is also possible that one container is provided for any one of these processes and another container is provided for the others of these processes.

In a case where the components of the developer are the toner, resin and solvent, almost all of the above-mentioned separated solvent is the solvent. Accordingly, it is possible to supply the separated solvent to the cleaning device 60 and/or the developing device 40 so as to reuse the separated solvent as a make-up solvent for the cleaning liquid and/or the developer.

Figure 3:
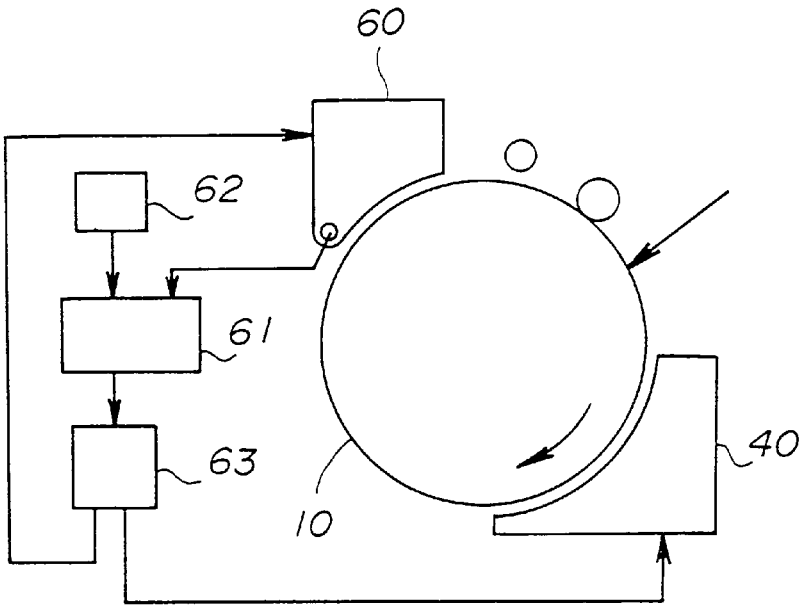
FIG. 3 illustrates an example of separated solvent circulation paths in the copying machine shown in FIG. 1.
Figure 4:
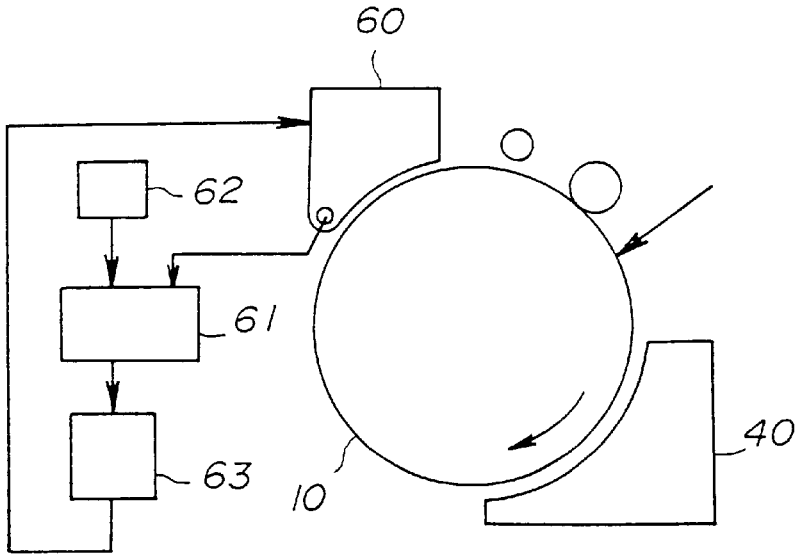
FIG. 4 illustrates another example of a separated solvent circulation path in the copying machine shown in FIG. 1.

FIG. 3 shows an example of an arrangement of a copying machine in which circulation paths are provided for supplying the separated solvent from the separated liquid tank 63 to the cleaning device 60 and to the developing device 40. FIG. 4 shows an example of an arrangement of a copying machine in which a circulation path is provided for supplying the separated solvent from the separated liquid tank 63 only to the cleaning device 60. It is also possible to provide a circulation path for supplying the separated solvent from the separated liquid tank 63 only to the developing device 40.

Figure 5:
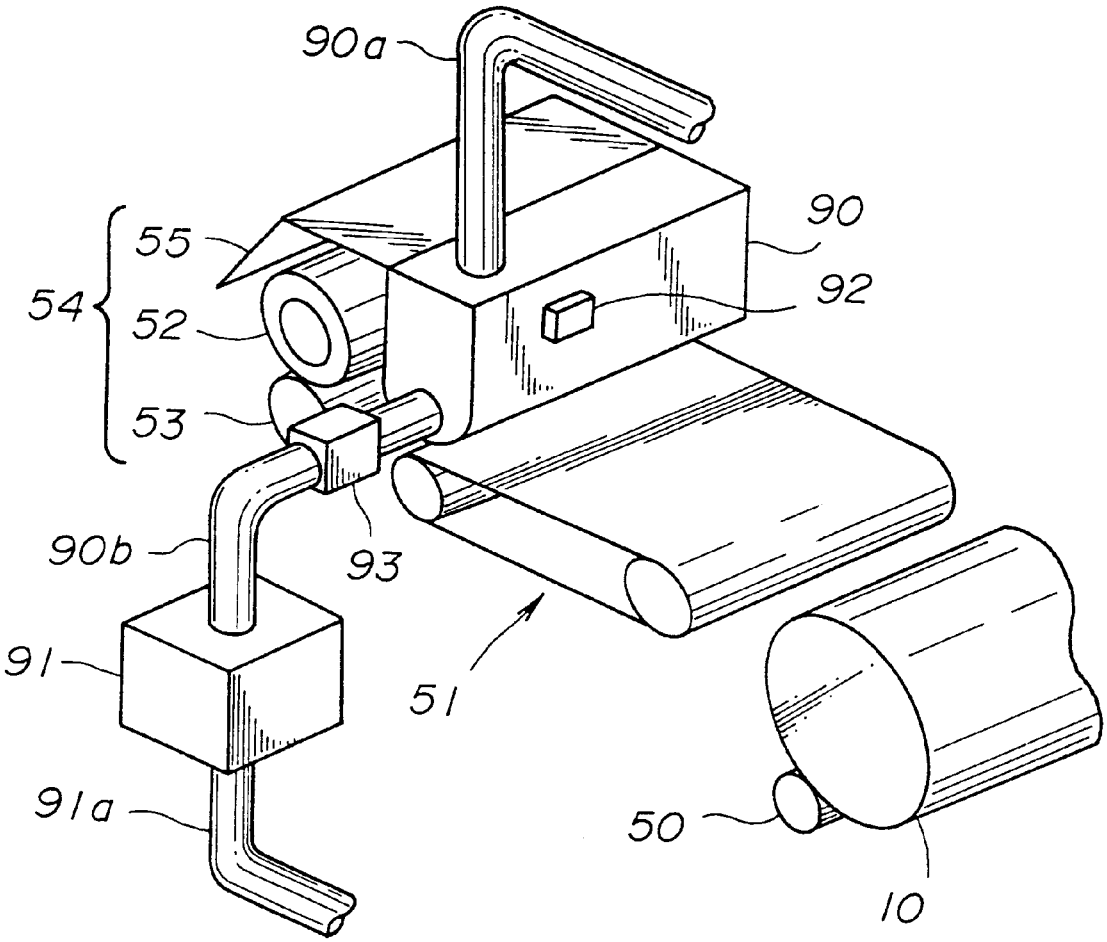
FIG. 5 shows a perspective view of the arrangement of an example of storing, gelling, pressing and separating means in the copying machine shown in FIG. 1.

In the copying machine in the first embodiment of the present invention, the above-mentioned collected developer is heated in a range on the order of 45 to 80° C. so as to increase the reaction speed of the gelation. For example, by disposing the gelling unit 61 shown in FIG. 2 in close proximity to the fixing device 54 (shown in FIG. 5), the temperature of the developer stored in the storage and pressure container portion 61*a* can be increased by residual heat or generated heat of the fixing device 54. It is also possible to provide a heater especially for heating the gelling unit 61 in addition to disposing the gelling unit 61 in close proximity to the fixing device 54. As shown in FIG. 5, the fixing device 54 is provided with the heat insulating cover 55 for controlling radiation of heat to the outside. However, there is some temperature increase around the fixing device 54. Thereby, the temperature of the storage and pressure container portion 61*a* increases.

In the arrangement shown in FIG. 5, a storage container 90 for the storage process and the gelation process and a pressure container 91 for the pressure process and the separation process are separately provided. The two containers 90 and 91 are connected by a pipe 90*b*. The collected developer is sent from a cleaning device 60 (such as that shown in FIG. 1) to the storage container 90 through a pipe 90*a* and is stored in the storage container 90. The storage container 90 is disposed above the conveying belt device 51 in close proximity to and in parallel to the heater roller 52 so that the storage container 90 can receive heat from the fixing device efficiently.

The collected developer sent from the cleaning device 60 through the collecting pipe 90*a*, which is mounted above the storage container 90, and stored in the storage container 90 is heated by heat from the fixing device 54. Then, the oil absorbing polymer material is added to the storage container 90 from an oil absorbing material adding unit 62 (such as that shown in FIG. 1). Thereby, the stored developer is gelled. The gelled developer is discharged from the storage container 90 through the exit pipe 90*b* provided at the bottom of the storage container 90. An electromagnetic valve 93 is provided to close the exit pipe 90*b*. The electromagnetic valve 93 is controlled so that the valve 93 is closed until gelation of the collected developer stored in the storage container 90 is finished, and the valve 93 is opened after the gelation of the collected developer stored in the storage container 90 is finished and the gelled developer is discharged therefrom.

The gelled developer discharged from the storage container 90 enters the pressure container 91 and undergoes the pressure process and the separation process. The developer solvent pressed out of the gelled developer in the pressure container 91 is discharged to a separated liquid tank 63 (such as that shown in FIG. 1) through a pipe 91*a*.

A liquid level sensor 92 is provided on a side wall of the storage container 90 for detecting the level of the top surface of the stored developer in the storage container 90. This sensor 92 is connected to a detecting circuit 96 (such as that shown in FIG. 6) which is connected to a control portion 97 such as a microcomputer (such as that shown in FIG. 6). An actuator which controls addition of the oil absorbing polymer material from an oil absorbing material adding unit 62 (such as that shown in FIG. 1) to the storage container 90 is connected with the control portion 97. Thereby, storage of a fixed amount of the collected developer in the storage container 90 is detected, and then, the oil absorbing polymer material is added to the developer stored in the storage container 90 from the oil absorbing material adding unit 62.

Figure 6:
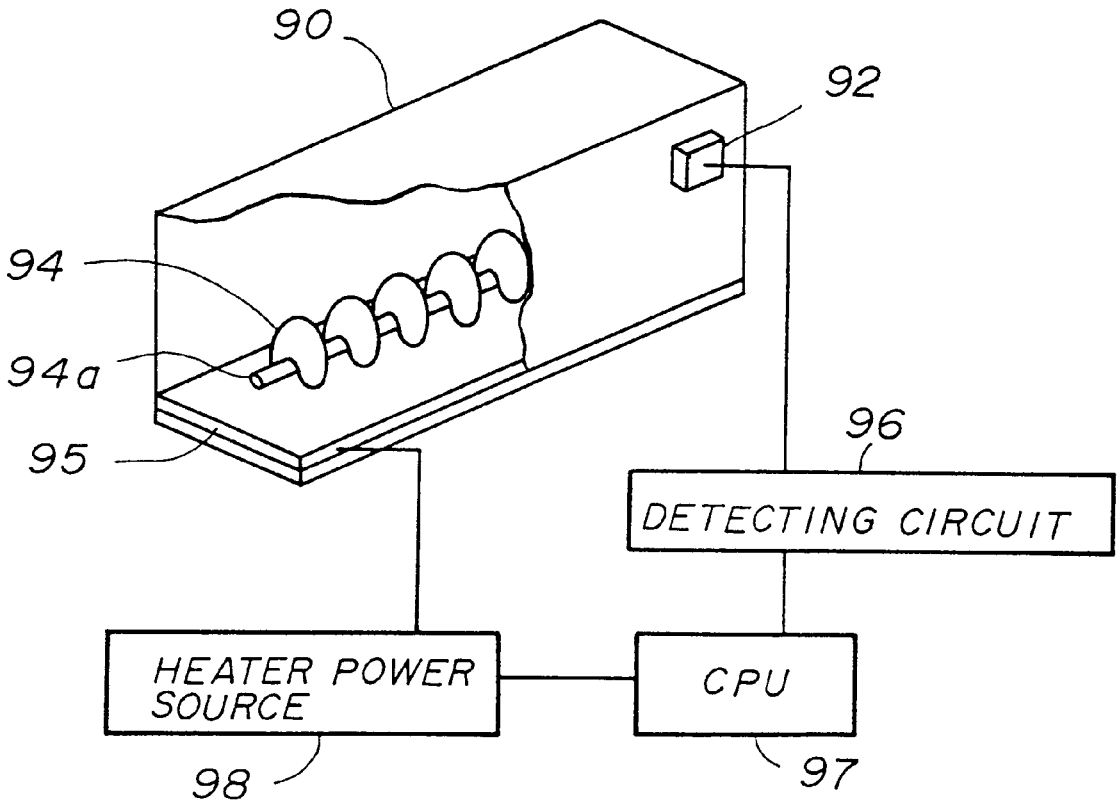
FIG. 6 shows a perspective view (part of side walls and a top plate being removed for the sake of illustrating an internal arrangement) of a storage container of another example of the gelling unit in the copying machine shown in FIG. 1.

In the example shown in FIG. 5, the storage container 90 is heated when the fixing device 54 operates. FIG. 6 shows an another example. In the example of FIG. 6, a heater 95 is provided inside and at the bottom of the storage container 90. A heater power source 98 for this heater 95 is connected with the control portion 97 and power supply to the heater 95 from the heater power source 98 is controlled by the control portion 97. This heater 95 is turned on when the oil absorbing polymer material is added to the developer stored in the storage container 90, the stored developer is heated and the temperature of the stored developer increases. This example is suitable for a case where the temperature which the stored developer finally reaches is set to a higher level. By supplying power to the heater 95 in the storage container 90 only when the heater of the heater roller 52 of the fixing device 54 is turned off, there is no increase in the power required for the entire apparatus, and the storage container 90 is heated every time when it is necessary.

In the storage container 90 in the arrangement shown in FIG. 6, a stirring and conveying screw 94 provided with a driving shaft 94*a* is provided. This stirring and conveying screw 94 is rotated when the heater 95 in the storage container 90 is turned on and the collected and stored developer is stirred. Further, after the developer is gelled, the electromagnetic valve 93 is opened and the gelled developer is conveyed by the stirring and conveying screw 94 to a pressure container 91 (such as that shown in FIG. 5). The stirring and conveying screw 94 provided with the driving shaft 94*a* is also provided in the storage container 90 in the arrangement shown in FIG. 5 for the same purposes. The difference between the arrangement shown in FIG. 5 and the arrangement shown in FIG. 6 is only that the heater 95 in the storage container 90 and the heater power source 98 are provided in the arrangement of FIG. 6 and are not provided in the arrangement of FIG. 5.

Figure 7:
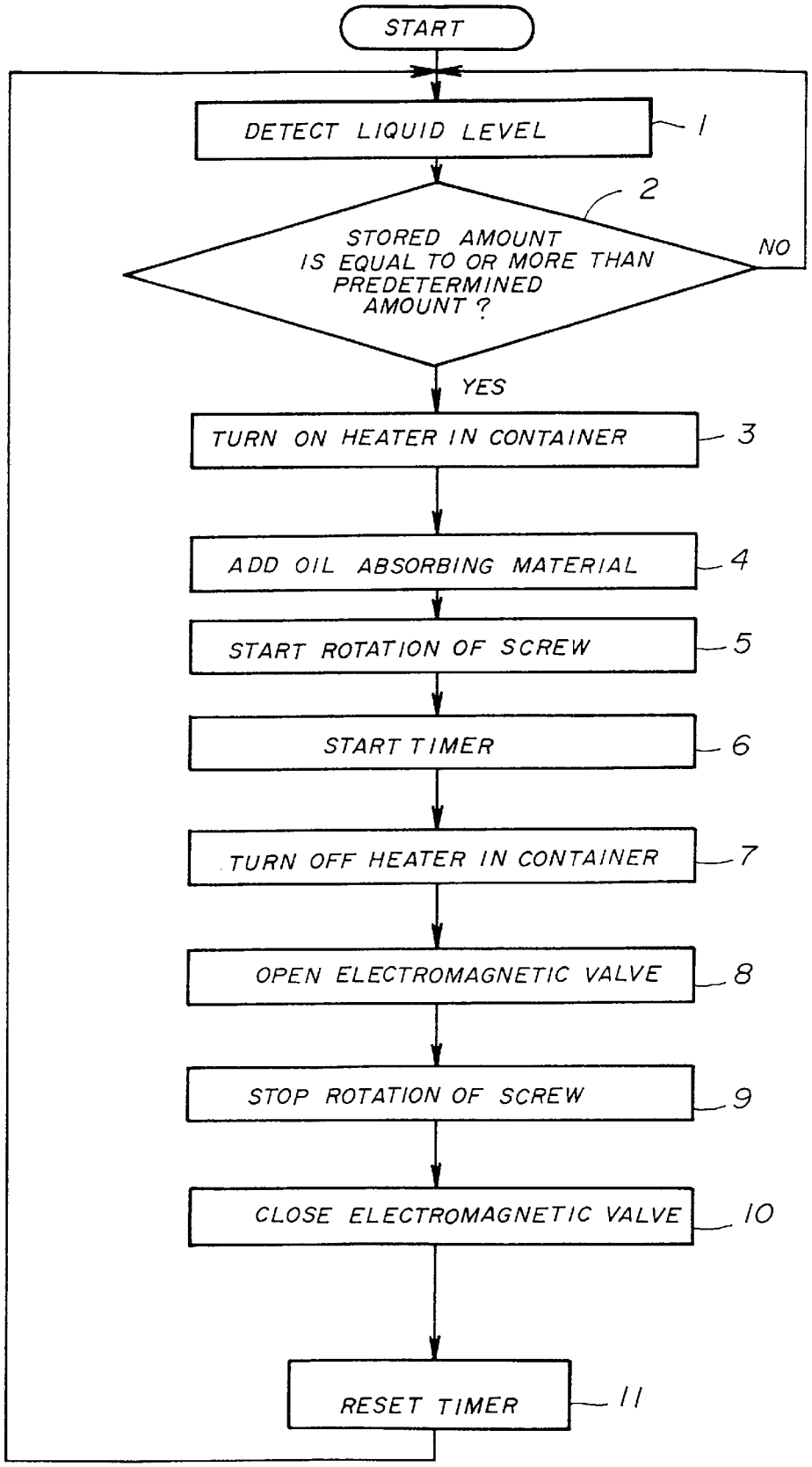
FIG. 7 shows an example of an operation flowchart of control, concerning a gelling process, of the copying machine shown in FIG. 1.

FIG. 7 shows an operation flowchart of the copying machine provided with the arrangement shown in FIG. 6. This copying machine also has the arrangement shown in either FIG. 3 or FIG. 4 (However, the gelling unit 61 shown in FIG. 3 and FIG. 4 is replaced with the storage container 90, the pressure container 91, the pipe 90*b* and the electromagnetic valve 93). In a step 1, the signal from the liquid level sensor 92 is read. When this signal indicates that the amount of the collected developer which has been stored in the storage container 90 is equal to or more than a predetermined amount (YES in a step 2), heating of the developer stored in the storage container 90 is started in a step 3, the oil absorbing polymer material is added to the developer stored in the storage container 90 in a step 4, the rotation of the stirring and conveying screw 94 is started in a step 5 and a timer is started in a step 6. Then, when the time measured by the timer has reached a first predetermined time, the heating of the developer stored in the storage container 90 is stopped in a step 7 and the electromagnetic valve 93 is opened in a step 8. Then, when the time measured by the timer has reached a second predetermined time, the rotation of the stirring and conveying screw 94 is stopped in a step 9, the electromagnetic valve 93 is closed in a step 10, and the timer is reset to zero in a step 11.

The operation flowchart shown in FIG. 7 can also be applied to the arrangement shown in FIG. 5. However, in this case, the step 3 (turning on the heater in the container) and the step 7 (turning off the heater in the container) are omitted.

Figure 8A:
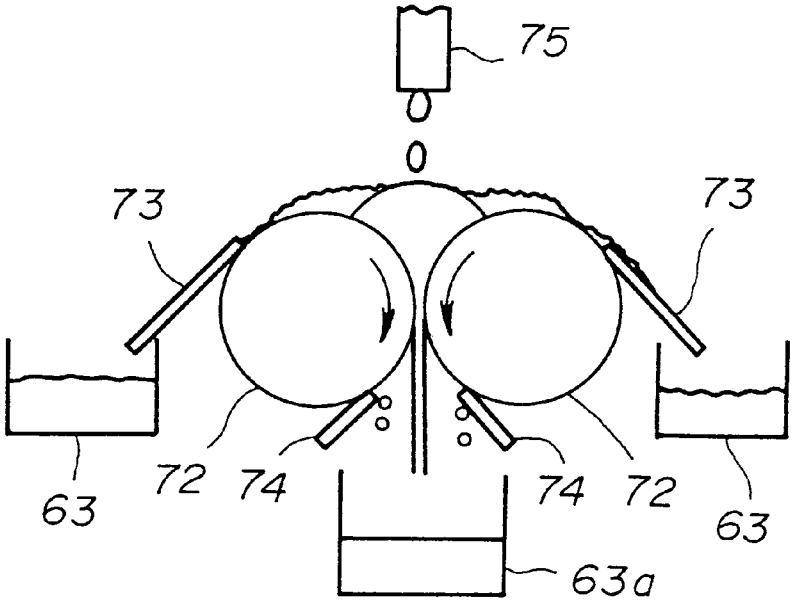
FIGS. 8A and 8B illustrate examples of pressure separating devices, respectively, which can be used in the copying machine shown in FIG. 1.
Figure 8B:
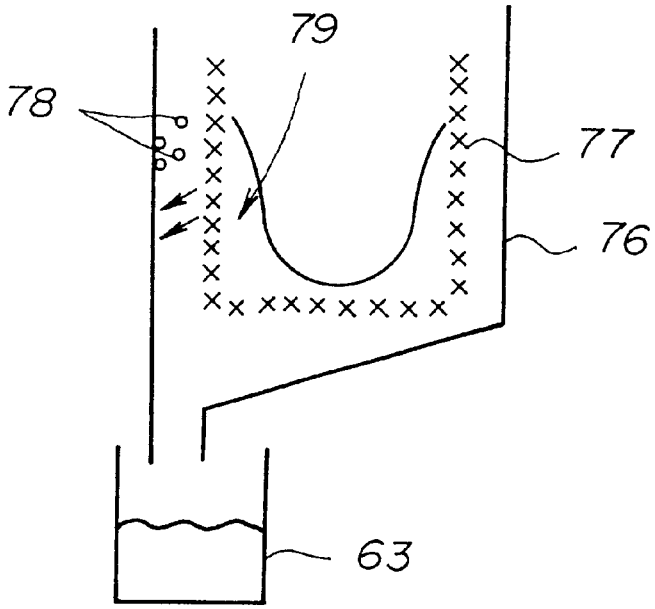

FIGS. 8A and 8B show variant embodiments of the above-described pressure separating device. A pressure separating device shown in FIG. 8A performs the separation by pressure, similar to the above-described device. This pressure separating device is provided with a pair of pressing rollers 72. The pair of pressing rollers 72 are driven and rotated so that the circumferential surfaces of the rollers 72 move downward at the position where the rollers 72 face one another. By the rotation of the rollers 72, the gelled developer is pressed at the position where the rollers face one another. Further, the gelatinous solid component is discharged downward through the position where the rollers 72 face one another. The developer solvent component, which is pressed out of the gelled developer as a result of the gelled developer being pressed by the rollers 72, is stored in a wedge-shape area formed by the roller's circumferential surfaces above the position where the rollers 72 face one another. Then, the developer solvent component stored in the wedge-shape area overflows. This overflowing liquid is guided by blades 73, one end edge of which is in contact with the circumferential surfaces the rollers 72, respectively, and is received by liquid tanks 63. The gelatinous solid component which moves downward through the position, where the rollers 72 face one another, and adheres to the circumferential surfaces of the rollers 72 is removed from the circumferential surfaces of the rollers 72 by scrapers 74, and falls into a container 63*a*. The gelled developer is supplied through a pipe 75 provided above the position where the rollers 72 face one another.

A pressure separating device shown in FIG. 8B uses a centrifugal force for performing the separation process. This pressure separating device is provided with a fixed tank 76 which has a liquid drainage hole at the bottom thereof and a mesh tank 77 which is driven and rotated at high speed inside the fixed tank 76. By the centrifugal force generated by the high-speed rotation of the mesh tank 77, the gelled developer 79 supplied into the mesh tank 77 is pressed onto the circumferential wall of the mesh tank 77. Thereby, the gelled developer is separated into the toner component and the developer solvent component. The developer solvent component 78 passes through the meshes of the circumferential wall of the mesh tank 77, is received by the inner wall surface of the fixed tank 76, flows downward on the inner wall surface of the fixed tank 76, and falls into the separated liquid tank 63 through the liquid drainage hole of the fixed tank 76.

A second embodiment of the present invention will now be described.

Figure 9:
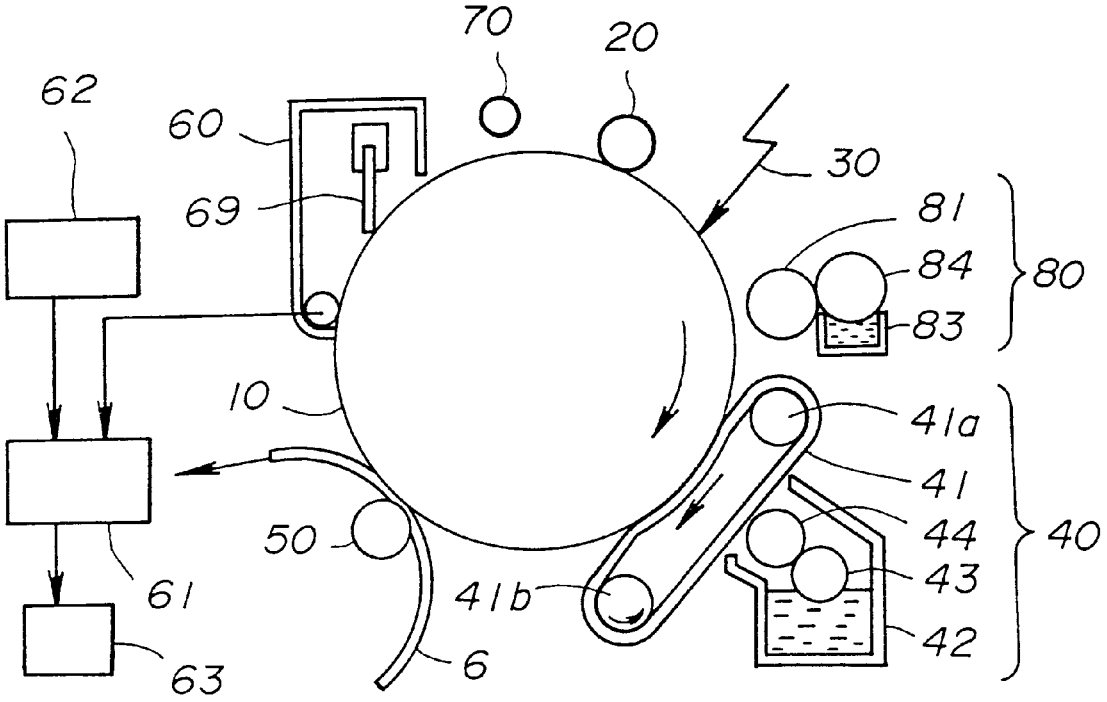
FIG. 9 shows a front sectional view indicating a general arrangement of a copying machine in a second embodiment of the present invention.

FIG. 9 shows a front view indicating a general arrangement of a copying machine in the second embodiment of the present invention. This copying machine is basically the same as the copying machine shown in FIG. 1. However, in the copying machine shown in FIG. 9, differently from the copying machine of FIG. 1, a process of coating a thin layer of high-concentration liquid developer on a developer carrier is performed, and also, before the thin layer of the liquid developer coated on the developer carrier contacts the latent image carrier so as to develop a latent image on the latent image carrier, a prewetting liquid coating process is performed. In the prewetting liquid coating process, an insulating and transparent prewetting liquid is coated on the latent image carrier.

The developing device 40 of this copying machine includes a developing belt 41 acting as the developer carrier, a developer tank 42 in which the liquid developer is contained, a drawing roller 43 disposed so that a bottom portion thereof is immersed in the developer in the developer tank 42, and a coating roller 44 which coats the developer, drawn up by the drawing roller 43, on the developing belt 41 so as to form a thin layer of developer on the developing belt 41. The developing belt 41 is stretched between first and second rollers 41*a*, 41*b*, and moves in the direction of the arrow at the same speed as that of the photoconductor 10 at the position where the developing belt 41 is in contact with the photoconductor 10.

It is preferable that an insulating liquid as the developer solvent of the developer has a viscosity in the range from 0.5 to 1000 mPa.s, an electrical resistance equal to or higher than $10^{12}$ Ωcm, surface tension equal to or lower than 21 dyn/cm, a boiling point equal to or higher than 100° C. By using an insulating liquid having the above-mentioned properties as the developer solvent, a high-viscosity developer can be provided.

Because the developer layer formed on the developing belt 41 is a thin layer, a very small amount of the insulating liquid is included in the developer layer. Accordingly, a very small amount of the insulating liquid is included in the developer supplied to the latent image surface of the latent image carrier (photoconductor 10). Therefore, a very small amount of the insulating liquid is absorbed by the transfer paper or the like when a developed image is transferred thereto. As a result, when the viscosity of the insulating liquid is equal to or lower than 1000 mPa.s, the insulating liquid will not adhere to the transfer paper. However, when the viscosity of the insulating liquid is equal to or lower than 0.5 mPa.s, the volatility is high and the insulating liquid is not suitable for use in a copying machine.

When the boiling point of the insulating liquid is equal to or lower than 100° C., a large amount of the insulating liquid is easily evaporated. Therefore, it is difficult to preserve properly the insulating liquid. For this purpose, it is necessary to form the entire apparatus as a sealed structure. Accordingly, such an insulation liquid is not suitable for use in a copying machine.

When the electrical resistance of the insulation liquid is lower than $10^{12}$ Ωcm, insulation is not sufficient, and such an insulation liquid can not be used in the developer. It is preferable that the electrical resistance of the insulating liquid is as high as possible.

When the surface tension of the insulating liquid is equal to or higher than 21 dyn/cm, the flow characteristics are not good, and the toner cannot easily move in the developer. It is preferable that the surface tension of the insulating liquid be as low as possible.

When the insulation liquid, the viscosity of which is in the range from 0.5 to 1000 mPa.s, and preferably, in the range from 20 to 50 mPa.s, is used as the developer solvent of the developer, the viscosity of the developer including the toner is on the order of 100 mPa.s in a condition where the weight ratio of the toner to the developer is on the order of 20%. A developer with this characteristic is suitable for use in a copying machine. When the viscosity of the developer is higher than the above-mentioned value, the developer may not be sufficiently conveyed while the developer is drawn up by the drawing roller 43 and is coated on the developing belt 41 by the coating roller 44. When the viscosity of the developer is lower than the above-mentioned value, the toner may be displaced in the developed image and the quality of the developed image may be degraded. Because part of the insulating liquid is transferred to the transfer paper, it is preferable to use a transparent liquid as the insulating liquid in order to prevent the background of the image, transferred to the transfer paper, from being stained.

Further, the copying machine is provided with a prewetting liquid coating device 80 for performing the above-mentioned prewetting liquid coating process. The device 80, as shown in FIG. 9, includes a prewetting liquid tank 83 in which the prewetting liquid 82 is contained, a drawing roller 84 disposed so that a bottom portion thereof is immersed in the prewetting liquid tank 83, and a coating roller 81 which coats the prewetting liquid, drawn up by the drawing roller 84, on the surface of the photoconductor 10 so as to form a thin layer of the prewetting liquid on the surface of the photoconductor 10.

It is preferable that the prewetting liquid has a viscosity in the range from 0.5 to 5 mPa.s, an electrical resistance equal to or higher than $10^{12}$ Ωcm, surface tension equal to or lower than 21 dyn/cm, and a boiling point in the range from 100° C. to 250° C., so that it is easier to evaporate than the above-mentioned developer. By having the above-mentioned properties, a preferable prewetting liquid can be obtained which has mold release characteristics and a good insulation characteristic.

Because the prewetting liquid is absorbed by the transfer paper or the like in the transfer process, it is necessary that the prewetting liquid evaporates in the fixing process. The Silicone oil or the like, which may be used as the prewetting liquid, is easy to evaporate as the viscosity thereof is lower. When the viscosity of the prewetting liquid is in the range from 0.5 to 5 mPa.s, the prewetting liquid is easy to evaporate and is preferable. When the viscosity of the prewetting liquid is equal to or higher than 5 mPa.s, the prewetting liquid is not easy to evaporate. When the viscosity of the prewetting liquid is equal to or lower than 0.5 mPa.s, the volatility thereof is so high that the prewetting liquid is dangerous and use of such a prewetting liquid is legally controlled. Accordingly, such a prewetting liquid is not suitable for use in a copying machine. The relationship between the viscosity and the ease to evaporate is similar to that of organic solvents such as Isoper (brand name of EXXON CHEMICAL Co., Ltd.).

When the boiling point of the prewetting liquid is equal to or lower than 100° C., this prewetting liquid is easy to evaporate and thus, it is difficult to appropriately preserve the prewetting liquid. In this case, it is necessary to provide the entire apparatus as a sealed structure. Otherwise, it is difficult to improve the operational environment. When the boiling point of the prewetting liquid is equal to or higher than 250° C., it is necessary to heat the transfer paper or the like to a higher temperature in the fixing process. Thereby, the transfer paper curls and cannot be used. Further, additional energy is necessary to heat the transfer paper. Thus, the cost for performing image forming is increased.

When the electrical resistance of the prewetting liquid is lower than $10^{12}$ Ωcm, the insulation property is not good, and thereby, there is a possibility that the latent image electrical charge and/or the toner electrical charge leaks through the prewetting liquid. Thus, such a prewetting liquid is not suitable for use in the copying machine. It is preferable that the electrical resistance of the prewetting liquid is as high as possible.

When the surface tension of the prewetting liquid is equal to or higher than 21 dyn/cm, the flow characteristics are not good and the toner cannot easily move in the prewetting liquid. It is preferable that the surface tension of the prewetting liquid is as low as possible.

The prewetting liquid is coated on the surface of the photoconductor 10 so as to form a film having a thickness of several μm thereon. For this purpose, it is preferable to use a solvent having a low viscosity as the prewetting liquid. For example, when the viscosity of the prewetting liquid is on the order of 1 mPa.s, such a prewetting liquid is sufficiently suitable for use in the copying machine. Further, since part of the prewetting liquid is transferred to the transfer paper as mentioned above, it is preferable that the prewetting liquid is transparent and colorless, in order to avoid a situation where the transfer paper is stained.

The developing process of this copying machine is similar to the developing process which is disclosed in Japanese Laid-Open Patent Application No.7-209922 with reference to FIGS. 3, 4, 5, 6 and 7. These figures correspond to FIGS. 10, 10A, 10B, 10C1 and 10C2 of the present application, respectively. In FIGS. 10, 10A, 10B, 10C1 and 10C2, the developing process includes of an approaching process in which the developing belt 41 acting as the developer carrier approaches the photoconductor 10 and the developer approaches the surface of the photoconductor 10, a toner transfer process in which the developer comes into contact with the prewetting liquid and the toner is transferred, and a separating process in which the developing belt 41 is separated from the photoconductor 10 and toner adheres to the photoconductor 10 with residual toner remaining on the developer belt 41.

In the approaching process, as shown in FIG. 10A, the developing belt 41 and the photoconductor 10 face one another with a very small gap 'd' therebetween. In this process, the developer comprising the toner and the developer solvent and having a high viscosity comes into contact with the prewetting liquid. By this contact, the prewetting liquid which has a lower viscosity is somewhat pressed out and thus protrudes or spreads upwardly as shown in FIG. 10A.

In the toner transfer process, as shown in FIG. 10B, for the image portion on the photoconductor 10, the electrical charge on the photoconductor 10 and the electrical field formed between the developing belt 41 and the photoconductor 10 cause the toner to transfer to the latent image surface of the photoconductor 10, mainly due to Coulomb force or attraction. For the non-image portion on the photoconductor 10, because the surface of the photoconductor 10 is separated from the developer layer by the prewetting liquid layer, the toner does not adhere to the surface of the photoconductor 10.

In the separating process, for the non-image portion, as shown in FIG. 10C1, the developer remains on the developing belt 41. At the boundary surface between the prewetting liquid layer and the developer layer, when the two layers are separated from one another, part of the prewetting liquid layer having a lower viscosity moves to the developer layer. Accordingly, a separating point between the two layers occurs when a part of the prewetting liquid layer separates from another part of the prewetting liquid layer. For the image portion, as shown in FIG. 10C2, the toner, which has been transferred to the surface of the photoconductor 10, displaces the prewetting liquid layer. Therefore, the prewetting liquid layer is located on the toner layer, and separation occurs inside the prewetting liquid layer. A thin film layer, comprising the part of the developer solvent which remains after the toner has moved to the photoconductor 10 and the part of the prewetting liquid, is formed on the developing belt 41. The prewetting liquid remaining on the surface of the photoconductor 10 permits movement or transfer of the toner, due to the electrostatic force, to be easier during the transfer process.

The developer and the prewetting liquid, located on the surface of the photoconductor 10 after the above-described separating process, come into contact with the transfer paper 6, and the transfer process is performed. For the image portion on the surface of the photoconductor 10, because the transfer rate is on the order of 95%, a small amount of the toner remains on the surface of the photoconductor 10 together with the prewetting liquid and the developer solvent after the transfer process has been completed. When this residual toner and the developer solvent are collected from the surface of the photoconductor 10 by a cleaning member such as a cleaning blade 69 of the cleaning device 60, the above-mentioned prewetting liquid is collected.

Then, the developer including the prewetting liquid collected by the cleaning device 60 is stored in the gelling unit 61, and, similar to the copying machine shown in FIG. 1, after being gelled, the gelled developer is separated into the toner component and the developer solvent component. This developer solvent is stored in the separated liquid tank 63.

Further, the arrangement of the storage container 90, the pressure container 91, the pipe 90*b* and the electromagnetic valve 93 described with reference to FIG. 5 or FIG. 6 can be applied to this copying machine (shown in FIG. 9) as these elements are applied to the copying machine shown in FIG. 1. Further, the control described with reference to FIG. 7 can be applied to the present copying machine (shown in FIG. 9).

In the apparatus in each of the above-described first and second embodiments, the developer solvent of the developer is an oil-based solvent. However, the present invention can also be applied to a copying machine which uses a developer, the developer solvent of which is an aqueous solvent. In this case, a water absorbing polymer or the like can be used as the gelling agent.

Also in the copying machine shown in FIG. 9, by forming the circulation path (paths) to the cleaning device 60 and/or the developing device 40 as shown in FIGS. 3 and 4, the developer solvent separated from the developer can be reused. Specifically, the separated solvent can be reused as a make-up solvent for the cleaning liquid and/or the developer as a result of supplying the separated solvent to the cleaning device 60 and/or the developing device 40. The residual gelatinous solid component is discarded.

However, in a case where the kind of prewetting liquid is different from the kind of developer solvent, and/or the viscosities of these two liquids are different from one another, when the separated solvent is supplied to the developing device 40 and is reused as a make-up solvent for the developer, there is a possibility that the properties of the developer change and creates a difficulty. Specifically, because the developer solvent and the prewetting liquid are mixed in the separated solvent, when the kinds of these two liquids are different from one another, the electrical resistance and so forth of the developer in the developing device 40 changes and the developing characteristics change. Further, when the viscosities of the two liquids are different from one another, the viscosity of the developer in the developing device 40 changes. Thereby, when a developing belt or a developing roller is used for conveying the developer, the rate of supply of the developer to the photoconductor 10 depends on the viscosity of the developer and the rate of supply may change and cause the developing toner to change. In order to avoid such situations, it is preferable that the separated solvent is supplied only to the cleaning device 60, and is reused as the cleaning liquid. For example, the separated solvent is reused as a cleaning solvent in order to prevent the toner from adhering to a cleaning blade 69 acting as a cleaning member, shown in FIG. 9.

Further, in the copying machine in the second embodiment shown in FIG. 9, it is possible to reuse the above-mentioned separated solvent (separated from the gelled developer) in the prewetting liquid coating device 80 by providing a supply path for supplying the separated solvent to the prewetting liquid container 83 of the prewetting liquid coating device 80, instead of or in addition to the above-mentioned circulation path (paths) to the cleaning device 60 and/or the developing device 40. When the separated solvent is reused in the prewetting liquid coating device 80 and the device 80 is such that the coating roller 81 and so forth is used for conveying the prewetting liquid so that the rate of supply of the prewetting liquid to the photoconductor 10 depends on the viscosity of the prewetting liquid, it is preferable that the viscosities of the prewetting liquid and the developer solvent are the same. Further, it is also preferable that the kind of prewetting liquid and the kind of developer solvent are also the same.

An example of a combination of the prewetting liquid and the developer solvent, the kinds of these two liquids being the same and these two liquids having the same viscosities, is a combination of two liquid, each of which is Silicone, made by SHIN-ETSU CHEMICAL Co., Ltd., KF-96 (brand name), having a viscosity of 100 mPa.s. An example of a combination of the prewetting liquid and the developer solvent, having different viscosities, is the above-mentioned Silicone, KF-96 (brand name), having a viscosity of 100 mPa.s, used as the developer solvent, and the above-mentioned Silicone, KF-96 (brand name), having a viscosity of 500 mPa.s, used as the prewetting liquid.

Figure 11:
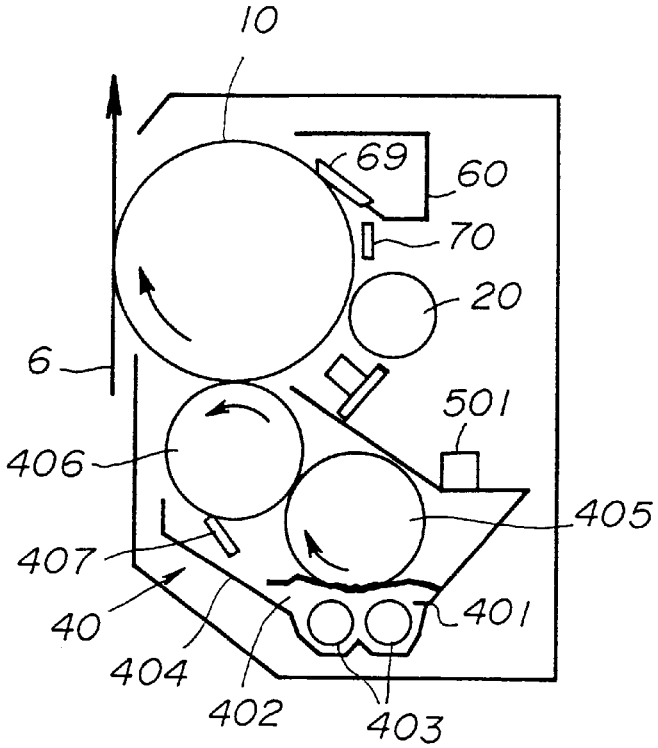
FIG. 11 shows a sectional view indicating a general arrangement of an image forming apparatus in a third embodiment of the present invention.

An image forming apparatus in a third embodiment of the present invention will now be described. In the image forming apparatus in the third embodiment, for means having functions similar to the functions of the means in the above-mentioned image forming apparatuses, the same reference numerals as those of the above-mentioned image forming apparatuses are given, and the descriptions thereof will be omitted. As shown in FIG. 11, the image forming apparatus in the third embodiment is not provided with the above-described prewetting liquid coating device 80.

In FIG. 11, a liquid developer 401 is stored in a developer storage portion 402 at the bottom of the developing device 40. By rotation of a developer stirring members 403, the developer 401 is circulated in a developing unit housing 404, and also, is supplied to a coating roller 405. The coating thickness of the developer 401 supplied to the coating roller 405 is adjusted by a measuring member or a liquid coating thickness control member (hereinafter, simply referred to as a control member) to a predetermined proper liquid coating thickness. The measuring member or the control member (not shown in FIG. 11) is disposed so as to be in contact with or in close proximity to the coating roller 405. As the coating roller 405, for example, a roller having a smooth surface or a gravure roller having an uneven surface, made of a material such as metal, rubber or the like, can be used. As the control member, when a smooth surface roller is used as the coating roller 405, a wire bar is suitable, and, when a gravure roller is used as the coating roller 405, a blade-shape member is suitable.

The liquid film of the developer 401 formed on the coating roller 405 is transferred to the surface of a developing roller 406 which is rotated counterclockwise and is in contact with or in close proximity to the coating roller 405. The developer 401 transferred to the developing roller 406 causes the latent image (image portion) formed on the photoconductor 10 to be visible. The developer 401 passing on the non-image portion (background portion) and not transferred to the photoconductor 10, is scraped by a roller scraper 407 which is in contact with the surface of the roller 406, and is returned to the developer storage portion 402.

Figure 12:
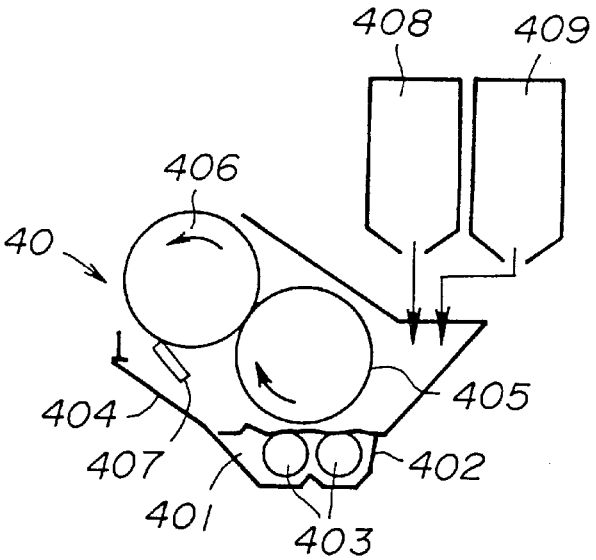
FIG. 12 shows a sectional view indicating a general arrangement of a developing device in the apparatus shown in FIG. 11.

As shown in FIG. 12, a make-up developer container 408 in which the make-up developer is contained and a make-up solvent container 409 in which the make-up developer solvent is contained are disposed above the developing unit 404. From the make-up developer container 408 and make-up solvent container 409, in order to maintain the amount of the developer 401 stored in the developer storage portion 402 to be a fixed amount, the make-up developer and the make-up developer solvent are supplied to the developer storage portion 402 through a developer supply hole 408*a* and a solvent supply hole 409*a* (see FIG. 13) formed on the developing device 40.

When all of the make-up developer and the make-up solvent contained in the make-up developer container 408 and the make-up solvent container 409 has been used, the developer 401 stored in the developer storage portion 402 will be separated from the coating roller 405, as shown in FIG. 12. When the developer 401 stored in the developer storage portion 402 has been separated from the coating roller 405, the developing device 40 is detached from the apparatus body, in order to supply the new developer and the new developer solvent to the make-up developer container 408 and the make-up solvent container 409 of the developing device 40, respectively, or in order to replace the developing device 40 with a new developing device. When the developing device is detached from the apparatus body, some amount of the developer still remains in the developing device 40.

In such a developing device using liquid developer, a drain (drainage hole) is provided at the bottom plate or a side wall near the bottom of the developing device in the related art. The drain is used for the old developer to flow out therethrough. However, in an image forming apparatus provided with such a developing device, when the developing device is inclined and the drain is opened, the liquid developer flows out therethrough. In such a case, all of the developer in the developing device may not flow out and some amount of the developer may remain in the developing device. Subsequently, when the developing device is detached from the apparatus body or when the detached developing device is carried, the residual developer may spill from the developing device through the drain. Further, the procedure of draining the developer from the developing device is troublesome and difficult.

Figure 13:
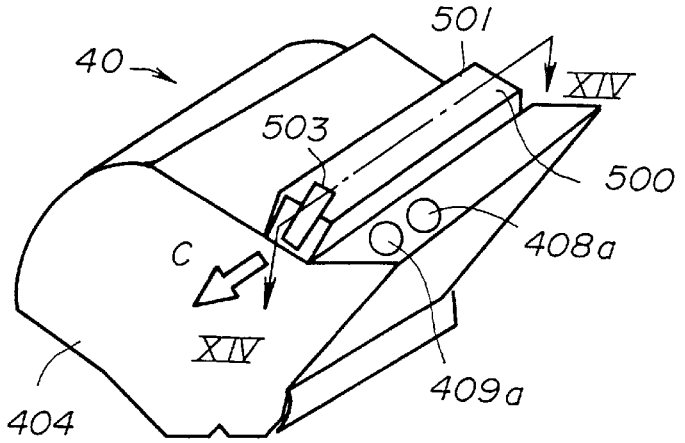
FIG. 13 shows a perspective view of a general structure of the developing device in the apparatus shown in FIG. 11.

In the image forming apparatus in the third embodiment, as shown in FIG. 13, a gelling agent adding unit 500 is provided on the top of the developing device 40, for adding the gelling agent to the developer remaining in the developing device 40 and thus gelling the remaining developer. The gelling agent is stored in a gelling agent case 501 of the gelling agent adding unit 500. The gelling agent adding unit 500 is located at a position such that the gelling agent can fall into the developing device 40 from the galling agent case 501 without splashing the coating roller 405 and the developing roller 406, and is added only to the developer 401 in the developer storage portion 402.

Figure 14A:
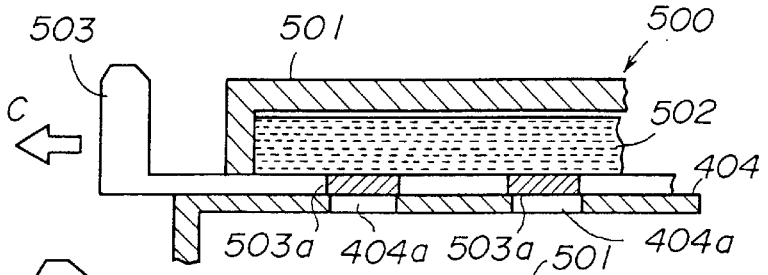
FIGS. 14A and 14B show sectional views taken along the plane XIV—XIV shown in FIG. 13 of a top portion of the developing device and a side portion of a gelling agent adding unit for illustrating the arrangement and the operation of the gelling agent adding unit in the apparatus shown in FIG. 11.
Figure 14B:
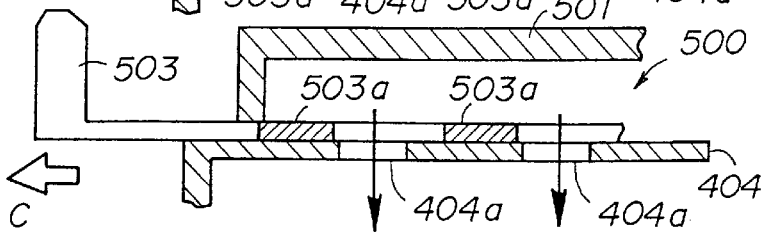

With reference to FIGS. 14A and 14B, an example of the operation of detachment of the developing device 40 from the apparatus body in this image forming apparatus will now be described. First, the above-mentioned make-up developer container 408 and make-up solvent container 409 are detached from the developing device 40. Then, an agent adding lever 503, which extends at a side portion of the gelling agent adding unit 500, is drawn in the arrow C direction. This agent adding lever 503 is provided in a manner such that the lever 503 can move forward and backward with respect to the gelling agent adding unit 500. In the state in which the gelling agent is stored in the gelling agent case 501, as shown in FIG. 14A, the agent adding lever 503 is in an initial position. In the initial position, the agent adding lever 503 has been pressed into the gelling agent case 501. Thus, in the initial position, as shown in FIG. 14A, closing portions 503*a* of the gelling agent adding lever 503 are located at positions such that agent adding holes 404*a* formed on the top of the developing unit housing 404 are closed by the closing portions 503*a*, respectively.

As a result of the agent adding lever 503 being drawn in the arrow C direction, as shown in FIG. 14B, the agent adding lever 503 moves to an agent adding position. In the agent adding position, the closing portions 503*a* of the agent adding lever 503 is shifted in the arrow C direction so as to be removed from the positions, under which the agent adding holes 404*a* of the developing unit housing 404 are located. Thereby, the closing portions 503*a* do not close the agent adding holes 404*a* of the developing unit housing 404, respectively. Thus, the agent adding holes 404*a* are opened, and the gelling agent 502 contained in the gelling agent case 501 is added to the inside of the developing device 40 through the agent adding holes 404*a*. Thereby, the developer remaining in the developer storage portion 402 of the developing device 40 is gelled. As a result, spilling of the residual developer from the developing device 40, when, for example, the developing device is carried, is prevented.

It is preferable that the agent adding lever 503 moves to the agent adding position automatically in response to an operation for starting detachment of the developing device 40 from the apparatus body. As a result of the movement of the agent adding lever 503 to the agent adding position, the gelling agent is added to the developer 401 in the developing device 40. The above-mentioned operation for starting detachment of the developing device 40 from the apparatus body is, for example, an operator's pressing of a button provided on the apparatus or an operator's turning of a lever provided on the apparatus. By the operation for starting detachment of the developing device 40 from the apparatus body, locking of the developing device 40 to the apparatus body is released. As a result, an operator can detach the developing device 40 from the apparatus body.

It is also possible to provide an arrangement by which, unless the make-up developer container 408 and the make-up solvent container 409 are detached from the body of the developing device 40, the operator's operation of drawing the agent adding lever 503 to the agent adding position is prevented. Instead, it is also possible to provide a lever locking member which prevents the agent adding lever 503 from being drawn by an operator to the agent adding position. Thereby, it is possible to avoid the situation that, although the developing device 40 loaded in the apparatus body is in the state in which the developing device 40 can properly operate (the state in which a sufficient amount of the developer is contained in the developing device 40), the agent adding lever 503 is erroneously drawn by an operator to the agent adding position and thus the developer in the developing device 40 is gelled.

In the above-described gelling agent adding unit 500, the agent adding holes 404*a* of the developing unit housing 404 are closed and opened as a result of movement of the agent adding lever 503. However, it is also possible that, for example, the agent adding holes 404*a* of the developing unit housing 404 are closed by sealing members and the agent adding lever 503 is provided with a cutter so that the sealing members are broken by the cutter of the agent adding lever 503 as a result of the agent adding lever 503 being moved so that the agent adding holes 404*a* are opened. It is also possible that the agent adding holes 404*a* of the developing unit housing 404 are closed by a sealing member, and the sealing member is directly pulled out so that the agent adding holes 404*a* of the developing unit housing 404 are opened. An optimum method is selected based on the shape and/or the material of the gelling agent.

When the liquid developer 401 is gelled as a result of the gelling agent 502 being added thereto, it is possible to leave the developer 401. In this case, the gelling agent 502 disperses naturally in the developer 401. It is also possible to actively mix the developer 401 and the gelling agent 502 with one another, for example, by stirring the liquid. By actively mixing the developer 401 and the gelling agent 502 with one another, it is possible to shorten the time required for gelling the developer 401.

Figure 15:
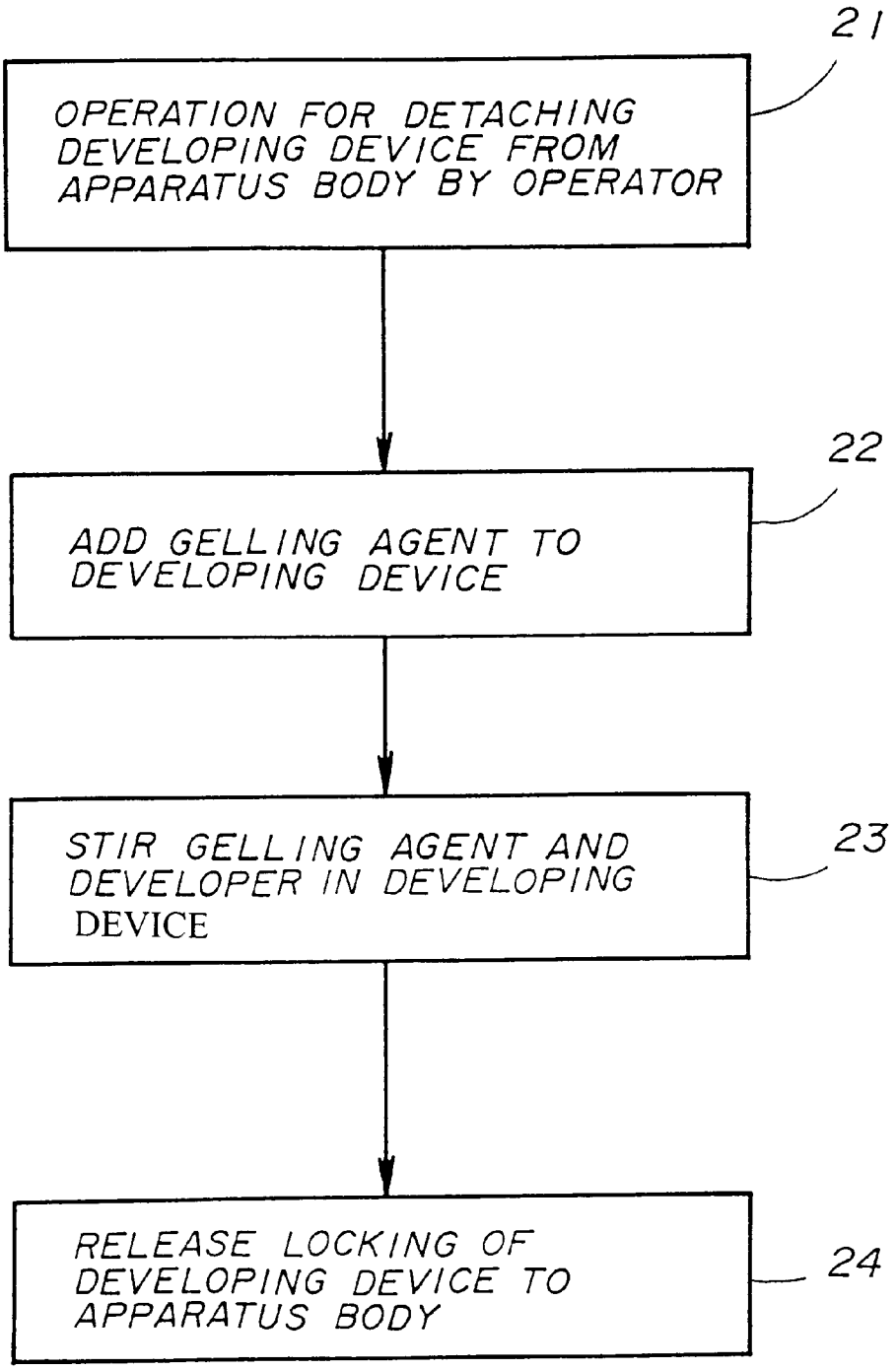
FIG. 15 shows an operation flowchart for illustrating an operation concerning gelation of the developer in the developing device and detachment of the developing device from the apparatus body in the apparatus shown in FIG. 11.

In the image forming apparatus in the third embodiment of the present invention, after the gelling agent 502 is added to the developer 401 in the developing device 40, each of the developer stirring members 403, which exist in the developing device 40, is rotated. Thereby, the developer 401 and the gelling agent 502 are actively mixed with one another. FIG. 15 shows an example of such an operation in the image forming apparatus in the third embodiment. In a step 21, an operator performs an operation for detaching the developing device 40 from the apparatus body. This operation for detaching the developing device 40 from the apparatus body is, for example, pressing a button provided on the apparatus, turning a lever provided on the apparatus, or the like. As a result of the operation for detaching the developing device 40 from the apparatus body, the gelling agent adding unit 500 automatically adds the gelling agent to the developer 401 in the developing device 40, in a step 22. Then, in a step 23, each of the developer stirring members 403 of the developing device 40 is automatically rotated. Thereby, without providing special stirring means, the developer 401 remaining in the developing device 40 and the gelling agent 502 added to the developer 401 are stirred. Thus, gelation of the developer is facilitated. At this time, the image forming apparatus is in a state in which the developing device 40 cannot be detached from the apparatus body as a result of a holding claw (not shown in the figures) acting as a fitting member provided to the apparatus body being fitted in a portion of the developing device 40. When gelation of the developer 401 has finished, the above-mentioned holding claw is automatically driven by a solenoid, a motor or the like, and thus, the fitting of the holding claw in the portion of the developing device 40 is released. As a result, an operator can detach the developing device 40 from the apparatus body. Detection of the finish of the gelation of the developer may be performed using a timer, for example.

As a method for preventing the above-mentioned residual developer from spilling, instead of the above-described method of gelling the developer using the gelling agent, it is also possible that, for example, a porous liquid absorber such as a sponge, a cloth or the like which is ordinarily in a compressed state is held in an appropriate position of the developing device 40, similar to the gelling agent adding unit 500, and, when the above-mentioned operation for detaching the developing device 40 is performed, the liquid absorber is released in the residual developer so that the liquid absorber absorbs the developer.

Further, the present invention is not limited to the above-described embodiments, and variations and modifications may be made without departing from the scope of the present invention.

What is claimed is:

1. An image forming apparatus, comprising:

developing means for developing a latent image formed on a latent image carrier by supplying a developer to said latent image carrier, said developer comprising a carrier liquid and a toner dispersed in said carrier liquid; and gelling agent adding means for adding a gelling agent to developer remaining in said developing means so as to gel said developer.

2. The image forming apparatus, according to claim 1, wherein said gelling agent adding means comprises:

gelling agent containing means for containing the gelling agent, said gelling agent containing means being located at a position such that the gelling agent contained in said gelling agent containing means is out of contact with the developer provided in said developing means; and gelling agent delivering means for delivering the gelling agent contained in said gelling agent containing means into said developing means in response to an operation for starting detachment of said developing means from the apparatus.

3. The image forming apparatus, according to claim 1, further comprising developer stirring controlling means for causing a developer stirring member, disposed in said developing means, to work so as to stir the developer after said gelling agent delivering means delivers the gelling agent into the developing means.

4. An image forming apparatus, comprising:

developing means for developing a latent image formed on a latent image carrier by supplying a developer to said latent image carrier, said developer comprising a carrier liquid and a toner dispersed in said carrier liquid; and liquid absorber delivering means for delivering a liquid absorber into the developer remaining in said developing means, said liquid absorber having a property of absorbing the developer.

5. An image forming apparatus, comprising:

developing means for developing a latent image formed on a latent image carrier by supplying a developer to said latent image carrier, said developer comprising a carrier liquid and a toner dispersed in said carrier liquid;

transferring means for transferring the developed image, formed on said latent image carrier by said developing means, to a transfer body;

cleaning means for removing residual developer from a surface of said latent image carrier so as to clean said surface of said latent image carrier after said transferring means transfers a developed image to the transfer body; and carrier liquid separating means for gelling the developer removed from said latent image carrier by said cleaning means, and separating the gelled developer into a gelatinous solid component and a carrier liquid component.

6. The image forming apparatus, according to claim 5, further comprising circulating means for supplying the carrier liquid component separated by said carrier liquid separating means to at least one of said developing means and said cleaning means.

7. The image forming apparatus, according to claim 5, further comprising a holding means for holding the gelatinous solid component separated by said carrier liquid separating means, said holding means being detachable from the apparatus.

8. The image forming apparatus, according to claim 5, wherein:

a rate of supply of the developer to said latent image carrier is dependent on viscosity of said developer provided in said developing means;

said apparatus further comprises prewetting liquid coating means for coating a prewetting liquid on the surface of said latent image carrier, before the developer is supplied to said latent image carrier by said developing means, in order to prevent direct contact of the developer with said surface of said latent image carrier; and a viscosity of the prewetting liquid is the same as a viscosity of the carrier liquid of the developer.

9. The image forming apparatus, according to claim 5, further comprising:

prewetting liquid coating means for coating a prewetting liquid on the surface of said latent image carrier, before the developer is supplied to said latent image carrier by said developing means, in order to prevent direct contact of the developer with said surface of said latent image carrier; and circulating means for supplying the carrier liquid component of the developer separated by said carrier liquid separating means to said cleaning means.

10. The image forming apparatus, according to claim 5, wherein:

the carrier liquid and the gelling agent have properties such that gelation of the developer is facilitated in a temperature range higher than an ambient temperature; and a developer containing portion provided in said carrier liquid separating means is located in proximity to a heat generating portion of said apparatus.

11. The image forming apparatus, according to claim 10, further comprising heating means for heating said developer containing portion.

12. The image forming apparatus, according to claim 11, further comprising controlling means for causing said heating means to start heating when an amount of the developer in said developer containing portion has reached a fixed amount.

13. The image forming apparatus, according to claim 10, wherein:

the carrier liquid is an oil-based liquid; and the gelling agent comprises an oil absorbing polymer material.

14. The image forming apparatus, according to claim 10, wherein said heat generating portion is a fixing device provided with heating means.

15. The image forming apparatus, according to claim 5, wherein:

the carrier liquid is an oil-based liquid; and the gelling agent comprises at least one of Alkyl styrene and Alkyl m-acrylate, each of which has a three-dimensional cross-linked structure.

16. The image forming apparatus, according to claim 5, wherein:

the carrier liquid is an oil-based liquid; and the gelling agent comprises at least one of 12-hydroxy stearic acid and N-lauroylglutamicacid dibutylamido.

17. The image forming apparatus, according to claim 5, wherein:

the carrier liquid is an oil-based liquid; and the gelling agent comprises Polyisobutylene having an oil attraction property.

18. An image forming apparatus, comprising:

a developing device which develops a latent image formed on a latent image carrier by supplying a developer to said latent image carrier, said developer including a carrier liquid and a toner dispersed in said carrier liquid; and a gelling agent adding device which adds a gelling agent to developer remaining in said developing device so as to gel said developer.

19. The image forming apparatus, according to claim 18, wherein said gelling agent adding device comprises:

a gelling agent container, in which the gelling agent is contained, said gelling agent container being located at a position such that the gelling agent contained in said gelling agent container is out of contact with the developer provided in said developing device; and a gelling agent delivering unit which delivers the gelling agent contained in said gelling agent container into said developing device in response to an operation for starting detachment of said developing device from the apparatus.

20. The image forming apparatus, according to claim 18, further comprising a developer stirring controlling unit which controls a developer stirring member, disposed in said developing device, to stir the developer after said gelling agent delivering unit delivers the gelling agent into the developing device.

21. An image forming apparatus, comprising:

a developing device which develops a latent image formed on a latent image carrier by supplying a developer to said latent image carrier, said developer comprising a carrier liquid and a toner dispersed in said carrier liquid; and a liquid absorber delivering unit which delivers a liquid absorber to developer remaining in said developing device, said liquid absorber having a property of absorbing the developer.

22. An image forming apparatus, comprising:

a developing device which develops a latent image formed on a latent image carrier by supplying a developer to said latent image carrier, said developer comprising a carrier liquid and a toner dispersed in said carrier liquid;

a transferring device which transfers a developed image, formed on said latent image carrier by said developing device, to a transfer body;

a cleaning device which removes residual developer from a surface of said latent image carrier so as to clean said surface of said latent image carrier after said transferring device transfers the developed image to the transfer body; and a carrier liquid separating device which gels the developer removed from said latent image carrier by said cleaning device, and separates the gelled developer into a gelatinous solid component and a carrier liquid component.

23. The image forming apparatus, according to claim 22, further comprising a circulating path for supplying the carrier liquid component separated by said carrier liquid separating device to at least one of said developing device and said cleaning device.

24. The image forming apparatus, according to claim 22, further comprising a holding unit for holding the gelatinous solid component separated by said carrier liquid separating device, said holding unit being detachable from the apparatus.

25. The image forming apparatus, according to claim 22, wherein:

a rate of supply of the developer to said latent image carrier depends on viscosity of said developer provided in said developing device;

said apparatus further comprises a prewetting liquid coating device which coats a prewetting liquid on the surface of said latent image carrier, before the developer is supplied to said latent image carrier by said developing device, in order to prevent direct contact of the developer with said surface of said latent image carrier; and a viscosity of the prewetting liquid is the same as a viscosity of the carrier liquid of the developer, respectively.

26. The image forming apparatus, according to claim 22, further comprising:

a prewetting liquid coating device which coats a prewetting liquid on the surface of said latent image carrier, before the developer is supplied to said latent image carrier by said developing device, in order to prevent direct contact of the developer with said surface of said latent image carrier; and a circulating path for supplying the carrier liquid component of the developer by said carrier liquid separating device to said cleaning device.

27. The image forming apparatus, according to claim 22, wherein:

the carrier liquid and the gelling agent have properties such that gelation of the developer is facilitated in a temperature range higher than an ambient temperature; and a developer containing portion provided in said carrier liquid separating device is located in proximity to a heat generating portion of said apparatus.

28. The image forming apparatus, according to claim 27, further comprising a heater for heating said developer containing portion.

29. The image forming apparatus, according to claim 28, further comprising a controlling unit which causes said heater to start heating when an amount of the developer in said developer containing portion has reached a fixed amount.

* * * * *